United States Patent [19]

Rioja et al.

[11] Patent Number: 4,961,792

[45] Date of Patent: Oct. 9, 1990

[54] ALUMINUM-LITHIUM ALLOYS HAVING IMPROVED CORROSION RESISTANCE CONTAINING MG AND ZN

[75] Inventors: Roberto J. Rioja, Burrell; Alex Cho, Monroeville; Philip E. Bretz, Pittsburgh, all of Pa.

[73] Assignee: Aluminum Company of America, Pittsburgh, Pa.

[21] Appl. No.: 172,506

[22] Filed: Mar. 24, 1988

Related U.S. Application Data

[63] Continuation-in-part of Ser. No. 685,731, Dec. 24, 1984, Pat. No. 4,797,165, which is a continuation-in-part of Ser. No. 594,344, Mar. 29, 1984, Pat. No. 4,648,913.

[51] Int. Cl.[5] ..... C22F 1/04

[52] U.S. Cl. ..... 148/12.7 A; 148/417

[58] Field of Search ..... 148/2, 11.5 A, 12.7 A, 148/415–418, 437–440

[56] References Cited

U.S. PATENT DOCUMENTS

| | | | |
|---|---|---|---|
| 2,915,390 | 12/1959 | Criner | 75/141 |
| 4,094,705 | 6/1978 | Sperry et al. | 148/2 |
| 4,571,272 | 2/1986 | Grimes | 148/11.5 |
| 4,582,544 | 4/1986 | Grimes et al. | 148/11.5 |
| 4,603,029 | 7/1986 | Quist et al. | 420/535 |
| 4,626,409 | 12/1986 | Miller | 420/533 |
| 4,636,357 | 1/1987 | Peel et al. | 420/532 |
| 4,648,913 | 3/1987 | Hunt, Jr. et al. | 148/12.7 |

FOREIGN PATENT DOCUMENTS

| | | |
|---|---|---|
| 150456 | 12/1984 | European Pat. Off. . |
| 158769 | 1/1985 | European Pat. Off. . |
| 156995 | 10/1985 | European Pat. Off. . |
| 210112 | 6/1986 | European Pat. Off. . |
| 3613224 | 4/1986 | Fed. Rep. of Germany . |
| 8502416 | 11/1984 | PCT Int'l Appl. . |
| 1387586 | 3/1975 | United Kingdom . |
| 2127847 | 3/1986 | United Kingdom . |

OTHER PUBLICATIONS

"Microstructure and Toughness of High Strength Aluminum Alloys" by J. T. Staley, ASTM STP605, pp. 71–103.

*Primary Examiner*—R. Dean

*Attorney, Agent, or Firm*—Andrew Alexander

[57] ABSTRACT

An aluminum base alloy wrought product having improved corrosion resistance in addition to combinations of strength and toughness. The product comprises 0.2 to 5.0 wt. % Li, 0.05 to 6.0 wt. % Mg, at least 2.45 wt. % Cu, 0.05 to 0.16 wt. % Zr, 0.05 to 12 wt. % Zn, 0.5 wt. % max. Fe, 0.5 wt. % max. Si, the balance aluminum and incidental impurities and has the ability to develop improved combinations of strength and toughness in response to an aging treatment. Prior to an aging step, the product having imparted thereto a working effect equivalent to stretching so that after an aging step it has improved combinations of strength and toughness.

35 Claims, 1 Drawing Sheet

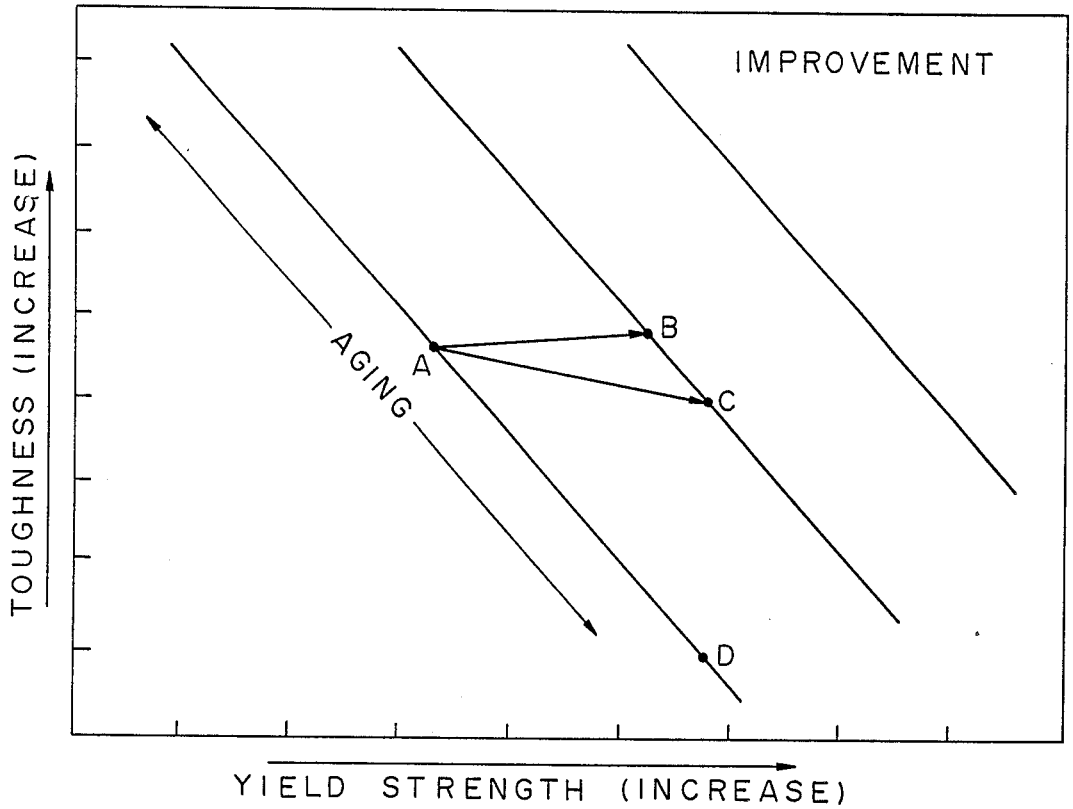
IMPROVEMENT
TOUGHNESS (INCREASE)
AGING
A
B
C
D
YIELD STRENGTH (INCREASE)

ALUMINUM-LITHIUM ALLOYS HAVING IMPROVED CORROSION RESISTANCE CONTAINING MG AND ZN

CROSS REFERENCE TO RELATED APPLICATIONS

This is a continuation-in-part of U.S. application Ser. No. 685,731, filed Dec. 24, 1984, now U.S. Pat. No. 4,797,165 which is a continuation-in-part of U.S. Ser. No. 594,344, filed Mar. 29, 1984, now U.S. Pat. No. 4,648,913, issued Mar. 10, 1987.

BACKGROUND OF THE INVENTION

This invention relates to aluminum base alloy products, and more particularly, it relates to improved lithium containing aluminum base alloy products having improved corrosion resistance and a method of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

It will be appreciated that both high strength and high fracture toughness appear to be quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased would result in a remarkably unique aluminum-lithium alloy product The present invention provides an improved lithium containing aluminum base alloy product which can be processed to improve strength characteristics while retaining high toughness properties or which can be processed to provide a desired strength at a controlled level of toughness.

SUMMARY OF THE INVENTION

A principal object of this invention is to provide a lithium containing aluminum base alloy product having improved corrosion resistance.

Another object of this invention is to provide an improved aluminum-lithium alloy wrought product having improved corrosion resistance in addition to strength and toughness characteristics.

Yet another object of this invention is to provide an aluminum-lithium alloy product having improved corrosion resistance and capable of being worked after solution heat treating to improve strength properties without substantially impairing its fracture toughness.

And yet another object of this invention includes a method of providing a wrought aluminum-lithium alloy product having improved corrosion resistance and working the product after solution heat treating to increase strength properties without substantially impairing its fracture toughness.

And yet a further object of this invention is to provide a method of increasing the strength of a wrought aluminum-lithium alloy product after solution heat treating without substantially decreasing fracture toughness.

These and other objects will become apparent from the specification, drawings and claims appended hereto.

In accordance with these objects, an aluminum base alloy wrought product having improved combinations of strength, fracture toughness and corrosion resistance is provided. The product can be provided in a condition suitable for aging and has the ability to develop improved strength in response to aging treatments without substantially impairing fracture toughness properties or corrosion resistance. The product comprises 0.2 to 5.0 wt.% Li, 0.05 to 6.0 wt.% Mg, at least 2.45 wt.% Cu, 0.05 to 0.16 wt.% Zr, 0.05 to 12 wt.% Zn, 0.5 wt.% max. Fe, 0.5 wt.% max. Si, the balance aluminum and incidental impurities. The product is capable of having imparted thereto a working effect equivalent to stretching so that the product has combinations of improved strength and fracture toughness after aging. In the method of making an aluminum base alloy product having improved combinations of strength, fracture toughness and corrosion resistance, a body of a lithium containing aluminum base alloy is provided and may be worked to produce a wrought aluminum product. The wrought product may be first solution heat treated and then stretched or otherwise worked amount equivalent to stretching. The degree of working as by stretching, for example, is normally greater than that used for relief of residual internal quenching stresses.

BRIEF DESCRIPTION OF THE DRAWINGS

The sole figure illustrates different toughness yield strength relationships where shifts in the upward direction and to the right represent improved combinations of these properties.

DETAILED DESCRIPTION OF THE PREFERRED EMBODIMENTS

The alloy of the present invention can contain 0.2 to 5.0 wt.% Li, 0 to 5.0 wt.% Mg, up to 5.0 wt.% Cu, 0 to 1.0 wt.% Zr, 0 to 2.0 wt.% Mn, 0.05 to 12.0 wt.% Zn, 0.5 wt.% max. Fe, 0.5 wt.% max. Si, the balance aluminum and incidental impurities. The impurities are preferably limited to about 0.05 wt.% each, and the combination of impurities preferably should not exceed 0.15 wt.%. Within these limits, it is preferred that the sum total of all impurities does not exceed 0.35 wt.%.

A preferred alloy in accordance with the present invention can contain 0.2 to 5.0 wt.% Li, at least 2.45 wt.% Cu, 0.05 to 5.0 wt.% Mg, 0.05 to 0.16 wt.% Zr, 0.05 to 12.0 wt.% Zn, the balance aluminum and impurities as specified above. A typical alloy composition would contain 1.5 to 3.0 wt.% Li, 2.55 to 2.90 wt.% Cu, 0.2 to 2.5 wt.% Mg, 0.2 to 11.0 wt.% Zn, 0.08 to 0.12 wt.% Zr, 0 to 1.0 wt.% Mn and max. 0.1 wt.% of each of Fe and Si. In a preferred typical alloy, Zn may be in the range of 0.2 to 2.0 and Mg 0.2 to 2.0 wt.%.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt.% Li does not provide for significant reductions in the density of the alloy. It is not presently expected that higher levels of lithium would improve the combination of toughness and strength of the alloy product.

It must be recognized that to obtain a high level of corrosion resistance in addition to the unique combinations of strength and fracture toughness as well as reductions in density requires careful selection of all the alloying elements. For example, for every 1 wt.% Li added, the density of the alloy is decreased about 2.4%. Thus, if density is the only consideration, then the amount of Li would be maximized. However, if it is desired to increase toughness at a given strength level, then Cu should be added. However, for every 1 wt.% Cu added to the alloy, the density is increased by 0.87% and resistance to corrosion and stress corrosion cracking is reduced. Likewise, for every 1 wt.% Mn added, the density is increased about 0.85%. Thus, care must be taken to avoid losing the benefits of lithium by the addition of alloying elements such as Cu and Mn, for example. Accordingly, while lithium is the most important element for saving weight, the other elements are important in order to provide the proper levels of strength, fracture toughness, corrosion and stress corrosion cracking resistance.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. For example, if more additions of lithium were used to increase strength without copper, the decrease in toughness would be greater than if copper additions were used to increase strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the upper limits of copper, since excessive amounts can lead to the undesirable formation of intermetallics which can interfere with fracture toughness. In addition, higher levels of copper can result in diminished resistance to corrosion and to stress corrosion cracking. Typically, copper should be less than 3.0 wt.%; however, in a less preferred embodiment, copper can be increased to less than 4.0 wt.% and preferably less than 3.5 wt.%. The combination of lithium and copper should not exceed 5.5 wt.% with lithium being at least 1.5 wt.% with greater amounts of lithium being preferred. Thus, in accordance with this invention, it has been discovered that adhering to the ranges set forth above for copper, fracture toughness, strength, corrosion and stress corrosion cracking can be maximized.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries.

Zirconium is the preferred material for grain structure control; however, other grain structure control materials can include Cr, V, Hf, Mn, Ti, typically in the range of 0.05 to 0.2 wt.% with Hf and Mn up to typically 0.6 wt.%. The level of Zr used depends on whether a recrystallized or unrecrystallized structure is desired. The use of zinc results in increased levels of strength, particularly in combination with magnesium. However, excessive amounts of zinc can impair toughness through the formation of intermetallic phases.

Zinc is important because, in this combination with magnesium, it results in an improved level of strength which is accompanied by high levels of corrosion resistance when compared to alloys which are zinc free. Particularly effective amounts of Zn are in the range of 0.1 to 1.0 wt.% when the magnesium is in the range of 0.05 to 0.5 wt.%, as presently understood. It is important to keep the Mg and Zn in a ratio in the range of about 0.1 to less than 1.0 when Mg is in the range of 0.1 to 1 wt.% with a preferred ratio being in the range of 0.2 to 0.9 and a typical ratio being in the range of about 0.3 to 0.8. The ratio of Mg to Zn can range from 1 to 6 when the wt.% of Mg is 1 to 4.0 and Zn is controlled to 0.2 to 2.0 wt.%, preferably in the range of 0.2 to 0.9 wt.%.

Working with the Mg/Zn ratio of less than one is important in that it aids in the worked product being less anisotropic or being more isotropic in nature, i.e., properties more uniform in all directions. That is, working with the Mg/Zn ratio in the range of 0.2 to 0.8 can result in the end product having greatly reduced hot worked texture, resulting from rolling, for example, to provide improved properties, for example in the 45° direction.

Toughness or fracture toughness as used herein refers to the resistance of a body, e.g. sheet or plate, to the unstable growth of cracks or other flaws.

The Mg/Zn ratio less than one is important for another reason. That is, keeping the Mg/Zn ratio less than one, e.g., 0.5, results not only in greatly improved strength and fracture toughness but in greatly improved corrosion resistance. For example, when the Mg and Zn content is 0.5 wt.% each, the resistance to corrosion is greatly lowered. However, when the Mg content is about 0.3 wt.% and the Zn is 0.5 wt.%, the alloys have a high level of resistance to corrosion.

Improved combinations of strength and toughness is a shift in the normal inverse relationship between strength and toughness towards higher toughness values at given levels of strength or towards higher strength values at given levels of toughness. For example, the figure, going from point A to point D represents the loss in toughness usually associated with increasing the strength of an alloy. In contrast, going from point A to point B results in an increase in strength at the same toughness level. Thus, point B is an improved combination of strength and toughness. Also, going from point A to point C results in an increase in strength while toughness is decreased, but the combination of strength and toughness is improved relative to point A. However, relative to point D, at point C, toughness is improved and strength remains about the same, and the combination of strength and toughness is considered to be improved. Also, taking point B relative to point D, toughness is improved and strength has decreased yet the combination of strength and toughness are again considered to be improved.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. Further, the alloy may be roll cast or slab cast to thicknesses from about ¼ to 2 or 3 inches or more depending on the end product desired. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li and Cu, and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituent to promote workability, this homogenization treatment is important in that it is believed to precipitate the Mn and Zr-bearing dispersoids which help to control final grain structure.

After the homogenizing treatment, the metal can be rolled or extruded or otherwise subjected to working operations to produce stock such as sheet, plate or extrusions or other stock suitable for shaping into the end product. To produce a sheet or plate-type product, a body of the alloy is preferably hot rolled to a thickness ranging from 0.1 to 0.25 inch for sheet and 0.25 to 6.0 inches for plate. For hot rolling purposes, the temperature should be in the range of 1000° F. down to 750° F. Preferably, the metal temperature initially is in the range of 900° to 975° F.

When the intended use of a plate product is for wing spars where thicker sections are used, normally operations other than hot rolling are unnecessary. Where the intended use is wing or body panels requiring a thinner gauge, further reductions as by cold rolling can be provided. Such reductions can be to a sheet thickness ranging, for example, from 0.010 to 0.249 inch and usually from 0.030 to 0.10 inch.

After rolling a body of the alloy to the desired thickness, the sheet or plate or other worked article is subjected to a solution heat treatment to dissolve soluble elements. The solution heat treatment is preferably accomplished at a temperature in the range of 900° to 1050° F. and preferably produces an unrecrystallized grain structure.

Solution heat treatment can be performed in batches or continuously, and the time for treatment can vary from hours for batch operations down to as little as a few seconds for continuous operations. Basically, solution effects can occur fairly rapidly, for instance in as little as 30 to 60 seconds, once the metal has reached a solution temperature of about 1000 to 1050° F. However, heating the metal to that temperature can involve substantial amounts of time depending on the type of operation involved. In batch treating a sheet product in a production plant, the sheet is treated in a furnace load and an amount of time can be required to bring the entire load to solution temperature, and accordingly, solution heat treating can consume one or more hours, for instance one or two hours or more in batch solution treating. In continuous treating, the sheet is passed continuously as a single web through an elongated furnace which greatly increases the heat-up rate. The continuous approach is favored in practicing the invention, especially for sheet products, since a relatively rapid heat up and short dwell time at solution temperature is obtained. Accordingly, the inventors contemplate solution heat treating in as little as about 1.0 minute. As a further aid to achieving a short heat-up time, a furnace temperature or a furnace zone temperature significantly above the desired metal temperature provides a greater temperature head useful in reducing heat-up times.

To further provide for the desired strength and fracture toughness, as well as corrosion resistance, necessary to the final product and to the operations in forming that product, the product should be rapidly quenched to prevent or minimize uncontrolled precipitation of strengthening phases referred to herein later.

After solution heat treatment and quenching as noted herein, the improved sheet, plate or extrusion and other wrought products can have a range of yield strength from about 25 to 50 ksi and a level of fracture toughness in the range of about 50 to 150 ksi $\sqrt{in}$. However, with the use of artificial aging to improve strength, fracture toughness can drop considerably. To minimize the loss in fracture toughness associated in the past with improvement in strength, it has been discovered that the solution heat treated and quenched alloy product, particularly sheet, plate or extrusion, must be stretched, preferably at room temperature, an amount greater than 1%, e.g. about 2 to 6% or greater, of its original length or otherwise worked or deformed to impart to the product a working effect equivalent to stretching greater than 1% of its original length. The working effect referred to is meant to include rolling and forging as well as other working operations. It has been discovered that the strength of sheet or plate, for example, of the subject alloy can be increased substantially by stretching prior to artificial aging, and such stretching causes little or no decrease in fracture toughness. It will be appreciated that in comparable high strength alloys, stretching can produce a significant drop in fracture toughness. Stretching AA7050 reduces both toughness and strength, as shown by the reference by J. T. Staley, mentioned previously. For AA2024, stretching 2% increases the combination of toughness and strength over that obtained without stretching; however, further stretching does not provide any substantial increases in toughness. Therefore, when considering the toughness-strength relationship, it is of little benefit to stretch AA2024 more than 2%, and it is detrimental to stretch AA7050. In contrast, when stretching or its equivalent is combined with artificial aging, an alloy product in accordance with the present invention can be obtained having significantly increased combinations of fracture toughness and strength.

While the inventors do not necessarily wish to be bound by any theory of invention, it is believed that deformation or working, such as stretching, applied after solution heat treating and quenching, results in a more uniform distribution of lithium-containing metastable precipitates after artificial aging. These metastable precipitates are believed to occur as a result of the introduction of a high density of defects (dislocations, vacancies, vacancy clusters, etc.) which can act as preferential nucleation sites for these precipitating phases (such as $T_1$, a precursor of the $Al_2CuLi$ phase) throughout each grain. Additionally, it is believed that this practice inhibits nucleation of both metastable and equilibrium phases such as $Al_3Li$, AlLi, $Al_2CuLi$ and $Al_5CuLi_3$ at grain and sub-grain boundaries. Also, it is believed that the combination of enhanced uniform precipitation throughout each grain and decreased grain boundary precipitation results in the observed higher combination of strength and fracture toughness in aluminum-lithium alloys worked or deformed as by stretching, for example, prior to final aging.

In the case of sheet or plate, for example, it is preferred that stretching or equivalent working is greater than 1%, e.g. about 2% or greater, and less than 14%. Further, it is preferred that stretching be in the range of about 2 to 10%, e.g., 3.7 to 9% increase over the original length with typical increases being in the range of 5 to 8%.

When the ingot of the alloy is roll cast or slab cast, the cast material may be subjected to stretching or the equivalent thereof without the intermediate steps or with only some of the intermediate steps to obtain strength and fracture toughness in accordance with the invention.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Some compositions of the alloy product are capable of being artificially aged to a yield strength as high as 95 ksi. However, the useful strengths are in the range of 50 to 85 ksi and corresponding fracture toughnesses are in the range of 25 to 75 ksi $\sqrt{in}$. Preferably, artificial aging is accomplished by subjecting the alloy product to a temperature in the range of 275° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments well known in the art, including natural aging. However, it is presently believed that natural aging provides the least benefit. Also, while reference has been made herein to single aging steps, multiple aging steps, such as two or three aging steps, are contemplated and stretching or its equivalent working may be used prior to or even after part of such multiple aging steps.

Specific strength, as used herein, is the tensile yield strength divided by the density of the alloy. Plate products, for example, made from alloys in accordance with the invention, have a specific strength of at least $0.75\times10^6$ ksi $in^3/lb$ and preferably at least $0.80\times10^6$ ksi $in^3/lb$. The alloys have the capability of producing specific strengths as high as $1.00\times10^6$ ksi $in^3/lb$.

The wrought product in accordance with the invention can be provided either in a recrystallized grain structure form or an unrecrystallized grain structure form, depending on the type of thermomechanical processing used. When it is desired to have an unrecrystallized grain structure plate product, the alloy is hot rolled and solution heat treated, as mentioned earlier. If it is desired to provide a recrystallized plate product, then the Zr is kept to a very low level, e.g., less than 0.05 wt.%, and the thermomechanical processing is carried out at rolling temperatures of about 800° to 850° F. with the solution heat treatment as noted above. For unrecrystallized grain structure, Zr should be above 0.10 wt.% and the thermomechanical processing is as above except a heat-up rate of not greater than 5° F./min and preferably less than 1° F./min is used in solution heat treatment.

If recrystallized sheet is desired having low Zr, e.g., less than 0.1 wt.%, typically in the range of 0.05 to 0.08 Zr, the ingot is first hot rolled to slab gauge of about 2 to 5 inches as above. Thereafter, it is reheated to between 700° to 850° F. then hot rolled to sheet gauge. This is followed by an anneal at between 500° to 850° F. for 1 to 12 hours. The material is then cold rolled to provide at least a 25% reduction in thickness to provide a sheet product. The sheet is then solution heat treated, quenched stretched and aged as noted earlier. Where the Zr content is fairly substantial, such as about 0.12 wt.%, a recrystallized grain structure can be obtained if desired. Here, the ingot is hot rolled at a temperature in the range of 800° to 1000° F. and then annealed at a temperature of about 800° F. to 850° F. for about 4 to 16 hours. Thereafter, it is cold rolled to achieve a reduction of at least 25% in gauge. The sheet is then solution heat treated at a temperature in the range of 950° to 1020° F. using heat-up rates of not slower than about 10° F./min with typical heat-up rates being as fast as 200° F./min with faster heat-up rates giving finer recrystallized grain structure. The sheet may then be quenched, stretched and aged.

Wrought products, e.g., sheet, plate and forgings, in accordance with the present invention develop a solid state precipitate along the (100) family of planes. The precipitate is plate like and has a diameter in the range of about 50 to 100 Angstroms and a thickness of 4 to 20 Angstroms. The precipitate is primarily copper or copper-magnesium containing; that is, it is copper or copper-magnesium rich. These precipitates are generally referred to as GP zones and are referred to in a paper entitled "The Early Stages of GP Zone Formation in Naturally Aged Al-4 Wt Pct Cu Alloys" by R. J. Rioja and D. E. Laughlin, *Metallurigcal Transactions A.* Vol. 8A, August 1977, pp. 1257–61, incorporated herein by reference. It is believed that the precipitation of GP zones results from the addition of Mg and Zn which is believed to reduce solubility of Cu in the Al matrix. Further, it is believed that the Mg and Zn stimulate nucleation of this metastable strengthening precipitate. The number density of precipitates on the (1 0 0) planes per cubic centimeter ranges from $1\times10^{15}$ to $1\times10^{17}$ with a preferred range being higher than $1\times10^{15}$ and typically as high as $5\times10^{16}$. These precipitates aid in producing a high level of strength without losing fracture toughness, particularly if short aging times, e.g., 15 hours at 350° F., are used for unstretched products.

The alloy of the present invention is useful also for extrusions and forgings with improved levels of mechanical properties, for example. Extrusions and forgings are typically prepared by hot working at temperatures in the range of 600 to 1000° F., depending to some extent on the properties and microstructures desired.

The following examples are further illustrative of the invention:

EXAMPLE 1

The alloys of the invention (Table 1) in this Example were cast into ingot suitable for rolling. Alloy A corresponds to AA2090, Alloy B corresponds to AA2090 plus 0.3 wt.% Mg, and Alloy C corresponds to AA2090 plus 0.6 wt.% Mg. Alloys A, B and C were provided for comparative purposes. The ingots were then homogenized at 950° F. for 8 hours followed by 24 hours at 1000° F., hot rolled to 1 inch thick plate and solution heat treated for one hour at 1020F. The specimens were quenched and stretched 2% and 6% of their original length at room temperature and then artificially aged. The samples stretched 2% were aged at 325° F. for 25 and 35 hours and the samples stretched 6% were aged at 325° F. for 15 and 20 hours.

Table 2 shows the highest attained specific strengths at 0, 2 and 6% stretch. Stretched and unstretched samples were also aged to measure corrosion performance. EXCO (ASTM G34) is a total immersion test designed to determine the exfoliation corrosion resistance of high strength 2XXX and 7XXX aluminum alloys.

Table 3 shows that Alloys E, F and G which had ratios of Mg to Zn of less than 1, performed better in the four day EXCO (ASTM G34) accelerated test for exfoliation corrosion than Alloys A, B, C and D which either contained no Zn (A, B, C) or had an Mg to Zn ratio of 1 (Alloy D). Also, Table 3 shows that Alloys A, B, C and D received many ratings of EC (severe exfoliation corrosion) or ED (very severe exfoliation). Alloy C suffered especially severe attack; all four samples received ED ratings after four days exposure to EXCO. Conversely, Alloys E, F and G received ratings that were predominantly EA (mild exfoliation) or EB (moderated exfoliation). Only one specimen from these three alloys was rated worse than EB. This was the 2% stretch 25 hour aging of Alloy E which was rated ED. This data indicates that Al-Cu-Li alloys with Mg to Zn ratios of less than 1 have improved resistance to exfoliation corrosion.

Tables 5, 6 and 7 list the strength and toughness exhibited by these alloys at 0, 2 and 6% stretch, respectively.

TABLE 1

Composition of the Seven Alloys in Weight Percent

| Alloy | Cu | Li | Mg | Zn | Zr | Si | Fe | Al |
|---|---|---|---|---|---|---|---|---|
| A | 2.5 | 2.2 | 0 | 0 | 0.12 | 0.04 | 0.07 | Balance |
| B | 2.5 | 2.2 | 0.3 | 0 | 0.12 | 0.04 | 0.07 | Balance |
| C | 2.5 | 2.1 | 0.6 | 0 | 0.12 | 0.04 | 0.07 | Balance |
| D | 2.6 | 2.2 | 0.6 | 0.6 | 0.12 | 0.04 | 0.07 | Balance |
| E | 2.5 | 2.2 | 0.5 | 1 | 0.12 | 0.04 | 0.07 | Balance |
| F | 2.6 | 2.1 | 0.3 | 0.5 | 0.12 | 0.04 | 0.07 | Balance |
| G | 2.6 | 2.2 | 0.3 | 0.9 | 0.12 | 0.04 | 0.07 | Balance |

TABLE 2

Specific Strengths ($\times 10^6$ KSI in$^3$/lb)

| Alloy | 0 Stretch | 2 Stretch | 6 Stretch | Computed Density |
|---|---|---|---|---|
| A | 0.71 | 0.81 | 0.82 | 0.0909 |
| B | 0.80 | 0.82 | 0.88 | 0.0908 |
| C | 0.81 | 0.84 | 0.93 | 0.0910 |
| D | 0.79 | 0.89 | 0.93 | 0.0915 |
| E | 0.83 | 0.87 | 0.90 | 0.0913 |
| F | 0.81 | 0.85 | 0.92 | 0.0910 |
| G | 0.90 | 0.90 | 0.93 | 0.0912 |

EXAMPLE 2

The alloys of the invention in this example are the same as those from Example 1 except they were hot rolled to 1.5 inch thick plate rather than to 1 inch plate before they were solution heat treated for one hour at 1020F. The specimens were quenched and artificially aged at 350° F. for 20 and 30 hours. Alloys E, F and G, which had ratios of Mg to Zn of less than 1, had better resistance to stress corrosion cracking (SCC) than Alloys A, B, C and D which either contained no Zn (A, B, C) or had a Zn to Mg ratio of 1 (Alloy D). The stress corrosion cracking test results are listed in Table 4 which also contains a description of the test procedures.

Alternate immersion testing in 3.5 wt.% NaCl solution (ASTM G44) is commonly used to evaluate the stress corrosion cracking performance of high strength aluminum alloys, per ASTM G47. It can be seen in the table that Alloys E, F and G have superior SCC resistance to the other four alloys since specimens from Alloys E, F and G have all survived 30 days in alternate immersion at 40,000 psi. One difference between the groups is the Mg to Zn ratio,which is less than 1 (based on weight) and achieves high resistance to stress corrosion.

TABLE 3

EXCO Ratings of Several Al-Li Alloys
1.0 Inch Thick Plate in T8 (Cold Work Prior to Aging) Temper

| Alloy | Stretch (%)* | Age (hr/°F.) | Tensile Yield Strength (Longitudinal) ksi | 2 Day | 4 Day |
|---|---|---|---|---|---|
| A | 2 | 25/325 | 66.8 | EC | ED |
| A | 2 | 35/325 | 71.5 | EC | EC |
| A | 6 | 15/325 | 68.4 | EA | EB |
| A | 6 | 20/325 | 72.4 | EA | EB |
| B | 2 | 25/325 | 73.7 | EB | EC |
| B | 2 | 35/325 | 73.5 | EB | EB |
| B | 6 | 15/325 | 75.7 | EC | EC |
| B | 6 | 20/325 | 78.0 | EC | EC |
| C | 2 | 25/325 | 73.9 | EC | ED |
| C | 2 | 35/325 | 77.6 | ED | ED |
| C | 6 | 15/325 | 78.0 | EC | ED |
| C | 6 | 20/325 | 81.5 | EC | ED |
| D | 2 | 25/325 | 77.8 | EB | EB |
| D | 2 | 35/325 | 73.5 | EB | EB |

TABLE 3-continued

EXCO Ratings of Several Al-Li Alloys
1.0 Inch Thick Plate in T8 (Cold Work Prior to Aging) Temper

| Alloy | Stretch (%)* | Age (hr/°F.) | Tensile Yield Strength (Longitudinal) ksi | 2 Day | 4 Day |
|---|---|---|---|---|---|
| D | 6 | 15/325 | 75.8 | EC | ED |
| D | 6 | 20/325 | 76.7 | EC | EC |
| E | 2 | 25/325 | 77.4 | EC | EC |
| E | 2 | 35/325 | 79.5 | EB | EB |
| E | 6 | 15/325 | 79.2 | EB | EB |
| E | 6 | 20/325 | 84.1 | EB | EB |
| F | 2 | 25/325 | 83.1 | EA | EA |
| F | 2 | 35/325 | 78.4 | EA | EA |
| F | 6 | 15/325 | 81.8 | EB | EB |
| F | 6 | 20/325 | 84.8 | EB | EB |
| G | 2 | 25/325 | 80.3 | EB | EB |
| G | 2 | 35/325 | 80.8 | EB | EB |
| G | 6 | 15/325 | 77.8 | EB | EB |
| G | 6 | 20/325 | 89.5 | EB | EB |

EXCO testing conducted per ASTM G34.
*In the unstretched condition, the alloys had a rating of EC or ED after four days.
EA = Mild Exfoliation
EC = Severe Exfoliation
EB = Moderate Exfoliation
ED = Very Severe Exfoliation

TABLE 4

Stress Corrosion Cracking Performance
of Several Al-Li Alloy Specimens.
1.5 Inch Thick Plate in T6 Condition
(No Cold Work Prior to Aging)

| Alloy | Age (hr/°F.) | 25 KSI* F/N** | 25 KSI* Days*** | 40 KSI* F/N** | 40 KSI* Days*** |
|---|---|---|---|---|---|
| A | 20/350 | 1/3 | 3 | 3/3 | 1,2,2 |
| A | 30/350 | 1/3 | 9 | 3/3 | 2,3,6 |
| B | 20/350 | 1/3 | 8 | 3/3 | 1,2,2 |
| B | 30/350 | 0/3 | — | 2/3 | 1,6,7 |
| C | 20/350 | 3/3 | 1,1,1 | 2/2 | 1,1 |
| C | 30/350 | 2/2 | 1,1 | 1/1 | 1 |
| D | 20/350 | 1/3 | 2 | 3/3 | 1,3,3 |
| D | 30/350 | 1/3 | 3 | 2/3 | 6,2 |
| E | 20/350 | 0/3 | — | 0/3 | — |
| E | 30/350 | 0/3 | — | 0/3 | — |
| F | 20/350 | 0/3 | — | 0/3 | — |
| F | 30/350 | 0/3 | — | 0/3 | — |
| G | 20/350 | 0/3 | — | 0/3 | — |
| G | 30/350 | 0/3 | — | 0/3 | — |

One eighth inch diameter smooth tensile bars tested in 3.5 wt. % NaCl solution by alternate immersion for 10 days, per ASTM G44.
*Ksi = Thousand pounds per square inch.
**F/N = Number of specimens that failed/Number of specimens in test.
***Days = Days to failure.

TABLE 5

Plate (1" Thick) Tensile Properties at 0% Stretch

| Alloy | Aged 25 hr. at 350° F. Tensile Yield Strength | Ultimate Tensile Strength | % Elongation | Fracture Toughness | Aged 30 hr. at 350° F. Tensile Yield Strength | Ultimate Tensile Strength | % Elongation | Fracture Toughness |
|---|---|---|---|---|---|---|---|---|
| A | 55.8 | 67.0 | 4.0 | 34.6 | 58.0 | 67.9 | 5.0 | 30.2 |
| A | 58.0 | 68.4 | 4.0 | 33.0 | 60.3 | 70.3 | 7.0 | 34.5 |
| B | 65.6 | 75.4 | 4.0 | 33.0 | 78.8 | 77.8 | 6.0 | 26.2 |
| B | 63.1 | 74.1 | 5.0 | 31.7 | 68.8 | 78.2 | 5.0 | 33.1 |
| C | 72.2 | 84.6 | 8.0 | 30.0 | 73.5 | 84.9 | 8.0 | 29.3 |
| C | 74.4 | 87.4 | 8.0 | 30.4 | 73.0 | 85.1 | 8.0 | 25.9 |
| D | 71.5 | 82.6 | 8.0 | 35.8 | 72.1 | 81.7 | 7.0 | 32.0 |
| D | 72.9 | 83.7 | 8.0 | 30.6 | 73.3 | 83.1 | 8.0 | 31.5 |
| E | 75.6 | 86.6 | 8.0 | 29.7 | 73.2 | 83.4 | 8.0 | 29.9 |
| E | 75.7 | 86.3 | 7.0 | 31.9 | 75.4 | 83.8 | 9.0 | 31.0 |
| F | 67.3 | 77.4 | 7.0 | 28.9 | 70.3 | 78.6 | 5.0 | 27.4 |
| F | 73.1 | 80.4 | 6.0 | 29.1 | 70.0 | 78.2 | 7.0 | 29.8 |
| G | 69.2 | 80.1 | 6.0 | 29.0 | 70.7 | 80.1 | 7.0 | 25.7 |
| G | 69.9 | 80.1 | 7.0 | 30.3 | 71.3 | 80.2 | 7.0 | 26.3 |

| Alloy | Aged 35 hr. at 350° F. Tensile Yield Strength | Ultimate Tensile Strength | % Elongation | Fracture Toughness |
|---|---|---|---|---|
| A | 62.3 | 71.1 | 5.0 | 32.3 |
| A | 62.5 | 72.3 | 5.0 | 33.5 |
| B | 66.6 | 76.7 | 6.0 | 30.6 |
| B | 71.4 | 79.6 | 5.0 | 29.9 |
| C | 74.0 | 85.5 | 9.0 | 28.1 |
| C | 73.7 | 85.0 | 8.0 | 29.6 |
| D | 71.3 | 81.7 | 7.0 | 31.1 |
| D | 71.5 | 81.8 | 9.0 | 32.1 |
| E | 75.4 | 85.0 | 8.0 | 29.5 |
| E | 73.3 | 83.5 | 8.0 | 28.7 |
| F | 70.3 | 78.6 | 8.0 | 24.7 |
| F | 72.5 | 80.2 | 5.0 | 26.3 |
| G | 71.7 | 81.1 | 7.0 | 26.4 |
| G | 73.9 | 82.3 | 8.0 | 26.1 |

ksi ksi $\sqrt{\text{in.}}$

TABLE 6

Plate (1" Thick) Tensile Properties at 2% Stretch

Aged 25 hr. at 325° F. | Aged 30 hr. at 325° F.

Frac-

TABLE 6-continued

| Plate (1" Thick) Tensile Properties at 2% Stretch | | | | | | | | |
|---|---|---|---|---|---|---|---|---|
| Alloy | Tensile Yield Strength | Ultimate Tensile Strength | % Elonga-tion | ture Tough-ness | Tensile Yield Strength | Ultimate Tensile Strength | % Elonga-tion | Fracture Toughness |
| A | 66.8 | 75.6 | 8.0 | 33.0 | 67.7 | 76.0 | 7.0 | 32.2 |
| A | 67.2 | 75.6 | 10.0 | 34.0 | 68.4 | 76.9 | 10.0 | 31.4 |
| B | 73.7 | 79.8 | 8.0 | 36.2 | 74.3 | 80.4 | 9.0 | 36.0 |
| B | 76.0 | 83.1 | 8.0 | 36.2 | 76.3 | 82.5 | 7.0 | 34.8 |
| C | 73.9 | 83.0 | 9.0 | 35.6 | 76.4 | 84.3 | 8.0 | 33.8 |
| C | 75.6 | 83.9 | 7.0 | 35.0 | 76.6 | 84.5 | 7.0 | 35.7 |
| D | 77.8 | 84.9 | 8.0 | 37.2 | 79.4 | 86.1 | 9.0 | 34.8 |
| D | 76.6 | 84.5 | 7.0 | 34.5 | 79.1 | 86.5 | 7.0 | 36.2 |
| E | 77.4 | 86.6 | 7.0 | 34.3 | 77.7 | 86.7 | 8.0 | 33.9 |
| E | 78.4 | 87.4 | 7.0 | 34.9 | 77.9 | 86.8 | 7.0 | 32.5 |
| F | 83.1 | 88.1 | 7.0 | 33.0 | 79.4 | 85.5 | 9.0 | 32.2 |
| F | 79.5 | 84.8 | 8.0 | 34.2 | 79.7 | 85.3 | 8.0 | 31.4 |
| G | 80.3 | 86.3 | 8.0 | 32.5 | 79.8 | 86.1 | 7.0 | 30.8 |
| G | 78.6 | 85.3 | 9.0 | 33.5 | 83.7 | 89.1 | 7.0 | 31.2 |

| | Aged 35 hr. at 325° F. | | | |
|---|---|---|---|---|
| Alloy | Tensile Yield Strength | Ultimate Tensile Strength | % Elongation | Fracture Toughness |
| A | 71.5 | 77.9 | 10.0 | 31.3 |
| A | 70.1 | 77.4 | 10.0 | 29.6 |
| B | 73.5 | 80.7 | 8.0 | 35.3 |
| B | 73.2 | 80.1 | 7.0 | 33.4 |
| C | 77.6 | 84.8 | 8.0 | 34.9 |
| C | 78.5 | 86.2 | 8.0 | 33.8 |
| D | 73.5 | 80.9 | 7.0 | 34.7 |
| D | 76.0 | 83.1 | 7.0 | 36.1 |
| E | 79.5 | 87.6 | 6.0 | 33.9 |
| E | 77.1 | 85.8 | 7.0 | 32.8 |
| F | 78.4 | 85.2 | 7.0 | 31.3 |
| F | 80.7 | 87.3 | 8.0 | 29.6 |
| G | 80.8 | 85.8 | 6.0 | 30.6 |
| G | 78.8 | 84.7 | 8.0 | 31.8 |

ksi ksi $\sqrt{\text{in.}}$

TABLE 7

| Plate (1" Thick) Tensile Properties at 6% Stretch | | | | | | | | |
|---|---|---|---|---|---|---|---|---|
| | Aged 15 hr. at 325° F. | | | | Aged 20 hr. at 325° F. | | | |
| Alloy | Tensile Yield Strength | Ultimate Tensile Strength | % Elonga-tion | Frac-ture Tough-ness | Tensile Yield Strength | Ultimate Tensile Strength | % Elonga-tion | Fracture Toughness |
| A | 68.4 | 75.2 | 9.0 | 34.4 | 72.4 | 78.4 | 8.0 | 31.6 |
| A | 68.0 | 74.9 | 9.0 | 33.3 | 72.7 | 78.2 | 8.0 | 30.7 |
| B | 75.7 | 81.8 | 6.0 | 39.7 | 78.0 | 83.5 | 7.0 | 36.0 |
| B | 75.1 | 81.5 | 6.0 | 36.8 | 77.0 | 81.9 | 8.0 | 39.7 |
| C | 78.0 | 85.3 | 7.0 | 35.3 | 81.5 | 88.6 | 9.0 | 37.5 |
| C | 77.4 | 85.2 | 8.0 | 37.3 | 82.7 | 87.9 | 7.0 | 35.6 |
| D | 75.8 | 83.2 | 9.0 | 37.3 | 76.7 | 83.6 | 6.0 | 38.1 |
| D | 74.1 | 81.7 | 7.0 | 36.5 | 77.9 | 84.9 | 7.0 | 35.4 |
| E | 79.2 | 85.5 | 7.0 | 39.5 | 84.1 | 88.1 | 5.0 | 36.6 |
| E | 79.4 | 86.2 | 7.0 | 38.0 | 84.8 | 89.6 | 9.0 | 36.4 |
| F | 81.8 | 86.9 | 6.0 | 34.8 | 84.8 | 86.8 | 9.0 | 31.2 |
| F | 81.6 | 86.8 | 9.0 | 37.0 | 81.5 | 88.6 | 8.0 | 36.0 |
| G | 77.8 | 83.3 | 6.0 | 33.9 | 89.5 | 86.6 | 7.0 | 34.0 |
| G | 80.7 | 86.3 | 7.0 | 33.6 | 79.6 | 84.8 | 7.0 | 32.8 |

| | Aged 25 hr. at 325° F. | | | |
|---|---|---|---|---|
| Alloy | Tensile Yield Strength | Ultimate Tensile Strength | % Elongation | Fracture Toughness |
| A | 73.4 | 79.1 | 9.0 | 29.3 |
| A | 73.3 | 79.1 | 12.0 | 31.6 |
| B | 80.4 | 84.2 | 8.0 | 37.5 |
| B | 80.3 | 84.5 | 8.0 | 38.0 |
| C | 84.5 | 89.9 | 8.0 | 35.8 |
| C | 84.2 | 89.3 | 8.0 | 34.2 |
| D | 81.3 | 86.6 | 8.0 | 33.7 |
| D | 82.2 | 87.9 | 6.0 | 34.3 |
| E | 85.1 | 88.3 | 6.0 | 34.0 |
| E | 85.0 | 89.4 | 6.0 | 34.9 |
| F | 82.2 | 86.6 | 7.0 | 34.7 |

TABLE 7-continued

| Plate (1" Thick) Tensile Properties at 6% Stretch | | | | |
|---|---|---|---|---|
| F | 81.8 | 87.8 | 7.0 | 32.5 |
| G | 80.9 | 85.6 | 6.0 | 32.7 |
| G | 79.4 | 84.3 | 7.0 | 33.7 |

ksi ksi $\sqrt{\text{in.}}$

While the invention has been described in terms of preferred embodiments, the claims appended hereto are intended to encompass other embodiments which fall within the spirit of the invention.

What is claimed is:

1. An aluminum base alloy wrought product having improved combinations of strength toughness, the product having the ability to develop improved combinations of strength and toughness in response to an aging treatment, the product comprised of 0.2 to 5.0 wt.% Li, 0.05 to 6.0 wt.% Mg, at least 2.45 wt.% Cu, 0.05 to 0.16 wt.% Zr, 0.05 to 12 wt.% Zn, 0.5 wt.% max. Fe, 0.5 wt.% max. Si, the balance aluminum and incidental impurities, the product having imparted thereto, prior to an aging step, a working effect equivalent to stretching so that after an aging step the product has improved combinations of strength and toughness.

2. The alloy in accordance with claim 1 wherein Li is the range of 1.5 to 3.0 wt.%.

3. The alloy in accordance with claim 1 wherein Li is in the range of 1.8 to 2.5 wt.%.

4. The alloy in accordance with claim 1 wherein Mg is in the range of 0.2 to 2.5 wt.%.

5. The alloy in accordance with claim 1 wherein Mg is in the range of 0.2 to 2.0 wt.%.

6. The alloy in accordance with claim 1 wherein Zn is in the range of 0.2 to 11.0 wt.%.

7. The alloy in accordance with claim 1 wherein Zn is in the range of 0.2 to 2.0 wt.%.

8. The alloy in accordance with claim 1 wherein Zr is in the range of 0.08 to 0.12 wt.%.

9. The alloy in accordance with claim 1 wherein Cu is in the range of 2.55 to 2.90 wt.%.

10. The product in accordance with claim 1 wherein the working effect is equivalent to stretching said product an amount in the range of 1 to 14%.

11. The product in accordance with claim 1 wherein the working effect is equivalent to stretching said product an amount in the range of 1 to 10%.

12. The product in accordance with claim 1 wherein the working effect is equivalent to stretching said product an amount in the range of 1 to 8%.

13. The product in accordance with claim 1 wherein the product is stretched an amount in the range of 1 to 14%.

14. The product in accordance with claim 1 wherein the product is stretched an amount in the range of 1 to 10%.

15. The product in accordance with claim 1 wherein the product is rolled an amount equivalent to stretching 1 to 14%.

16. The product in accordance with claim 1 wherein the product is forged an amount equivalent to stretching 1 to 14%.

17. An aluminum base alloy wrought product suitable for aging and having the ability to develop improved combinations of strength and fracture toughness in response to an aging treatment, the product comprised of 1.5 to 3.0 wt.% Li, 0.2 to 2.5 wt.% Mg, 2.55 to 2.90 wt.% Cu, 0.05 to 0.12 wt.% Zr, 0.2 to 11.0 wt.% Zn, 0.5 wt.% max. Fe, 0.5 wt.% max. Si, the balance aluminum and incidental impurities, the product having imparted thereto, prior to said aging, a working effect equivalent to stretching an amount 1 to 10% at room temperature in order that, after said aging, said product can have an improved combinations of strength and fracture toughness.

18. An aluminum base alloy wrought product suitable for aging and having the ability to develop improved combinations of strength and fracture toughness in response to an aging treatment, the product comprised of 1.8 to 2.5 wt.% Li, 0.2 to 2.0 wt.% Mg, 2.5 to 2.9 wt.% Cu, 0.08 to 0.12 wt.% Zr, 0.2 to 2.0 wt.% Zn, 0.5 wt.% max. Fe, 0.5 wt.% max. Si, the balance aluminum and incidental impurities, the product, prior to an aging step, stretched 1 to 10% in order that, after an aging step, said product has an improved strength level without a substantial decrease in fracture toughness.

19. Method of making aluminum base alloy products having combinations of improved strength, corrosion resistance and fracture toughness, the method comprising the steps of:

(a) providing a lithium-containing aluminum base alloy product consisting essentially of 0.2 to 5.0 wt.% Li, 0.05 to 6.0 wt.% Mg, 2.45 to 2.95 wt.% Cu, 0.05 to 0.12 wt.% Zr, 0.05 to 12 wt.% Zn, 0.5 wt.% max. Fe, 0.5 wt.% max. Si, the balance aluminum and incidental impurities, the product having imparted thereto, prior to an aging step, a working effect equivalent to stretching so that after an aging step the product has improved combinations of strength and toughness; and (b) imparting to said product, prior to an aging step, a working effect equivalent to stretching said product at room temperature in order that, after an aging step, said product can have improved combinations of strength and fracture toughness in addition to corrosion resistance.

20. The alloy in accordance with claim 19 wherein Li is in the range of 1.5 to 3.0 wt.%.

21. The alloy in accordance with claim 19 wherein Li is in the range of 1.8 to 2.5 wt.%.

22. The alloy in accordance with claim 19 wherein Mg is in the range of 0.2 to 2.5 wt.%.

23. The alloy in accordance with claim 1 wherein Mg is in the range of 0.2 to 2.0 wt.%.

24. The alloy in accordance with claim 1 wherein Zn is in the range of 0.2 to 11.0 wt.%.

25. The alloy in accordance with claim 1 wherein Zn is in the range of 0.2 to 2.0 wt.%.

26. The alloy in accordance with claim 1 wherein Zr is in the range of 0.08 to 0.12 wt.%.

27. The alloy in accordance with claim 1 wherein Cu is in the range of 2.55 to 2.90 wt.%.

28. The method in accordance with claim 19 wherein the working effect is equivalent to stretching said body an amount greater than 1%.

29. The method in accordance with claim 19 wherein the working effect is equivalent to stretching said body 1 to 14%.

30. The method in accordance with claim 19 wherein the working effect is equivalent to stretching said body 1 to 8%.

31. The method in accordance with claim 19 including homogenizing a body of said alloy at a temperature in the range of 900° to 1050° F. prior to forming into said product.

32. Method of making aluminum base alloy products having combinations of improved strength and fracture toughness, the method comprising the steps of:

(a) providing a lithium-containing aluminum base alloy product consisting essentially of 1.5 to 3.0 wt.% Li, 0.2 to 2.5 wt.% Mg, 2.55 to 2.90 wt.% Cu, 0.05 to 0.12 wt.% Zr, 0.2 to 11.0 wt.% Zn, 0.5 wt.% max. Fe, 0.5 wt.% max. Si, the balance aluminum and incidental impurities, the product having imparted thereto, prior to an aging step, a working effect equivalent to stretching so that after an aging step the product has improved combinations of strength and toughness; and (b) imparting to said product, prior to an aging step, a working effect equivalent to stretching said product an amount greater than 1% in order that, after said aging step, said product can have improved combinations of strength and fracture toughness.

33. The method according to claim 32 wherein said wrought product is stretched 1 to 12%.

34. The method according to claim 32 wherein said wrought product is stretched 1 to 8%.

35. An aluminum base alloy wrought product suitable for aging and having the ability to develop improved combinations of strength and fracture toughness in response to an aging treatment, the product comprised of 1.8 to 2.5 wt.% Li, 0.2 to 2.0 wt.% Mg, 2.5 to 2.9 wt.% Cu, 0.08 to 0.12 wt.% Zr, 0.2 to 2.0 wt.% Zn, 0.5 wt.% max. Fe, 0.5 wt.% max. Si, the balance aluminum and incidental impurities, the product having imparted thereto, prior to said aging, a working effect equivalent to stretching an amount 4 to 12% at room temperature in order that, after said aging, said product can have improved combinations of strength and fracture toughness.

* * * * *

UNITED STATES PATENT AND TRADEMARK OFFICE

CERTIFICATE OF CORRECTION

PATENT NO. : 4,961,792

DATED : October 9, 1990

INVENTOR(S) : Roberto J. Rioja et al

It is certified that error appears in the above-identified patent and that said Letters Patent is hereby corrected as shown below:

Title page:

Insert the terminal disclaimer notice as follows:

--(*) Notice: The portion of the term of this patent subsequent to March 10, 2004 has been disclaimed.--

| | |
|---|---|
| Col. 7, line 31 | Change "$T_1$," to --$T_1$',--. |
| Claim 23, Col. 16, line 56 | Change "1" to --19--. |
| Claim 24, col. 16, line 58 | Change "1" to --19--. |
| Claim 25, col. 16, line 60 | Change "1" to --19--. |
| Claim 26, col. 16, line 62 | Change "1" to --19--. |
| Claim 27, col. 16, line 64 | Change "1" to --19--. |

Signed and Sealed this

Tenth Day of November, 1992

*Attest:*

DOUGLAS B. COMER

*Attesting Officer*

*Acting Commissioner of Patents and Trademarks*